US009896638B2

(12) United States Patent
Mazzamaro et al.

(10) Patent No.: US 9,896,638 B2
(45) Date of Patent: Feb. 20, 2018

(54) ULTRA LOW PHOSPHORUS LUBRICANT COMPOSITIONS

(71) Applicant: VANDERBILT CHEMICALS, LLC, Norwalk, CT (US)

(72) Inventors: Glenn A. Mazzamaro, Middlebury, CT (US); Steven G. Donnelly, Bethel, CT (US); Ronald J. Hiza, Monroe, CT (US)

(73) Assignee: VANDERBILT CHEMICALS, LLC, Norwalk, CT (US)

( * ) Notice: Subject to any disclaimer, the term of this patent is extended or adjusted under 35 U.S.C. 154(b) by 0 days.

(21) Appl. No.: 15/368,041

(22) Filed: Dec. 2, 2016

(65) Prior Publication Data

US 2017/0081608 A1 Mar. 23, 2017

Related U.S. Application Data

(63) Continuation of application No. 14/861,521, filed on Sep. 22, 2015, now Pat. No. 9,546,340, which is a continuation of application No. 14/580,854, filed on Dec. 23, 2014, now abandoned, which is a continuation of application No. 14/230,777, filed on Mar. 31, 2014, now abandoned, which is a continuation of application No. 13/071,785, filed on Mar. 25, 2011.

(60) Provisional application No. 61/317,499, filed on Mar. 25, 2010.

(51) Int. Cl.

| | |
|---|---|
| ***C10M 141/08*** | (2006.01) |
| ***C10M 141/06*** | (2006.01) |
| ***C10M 141/10*** | (2006.01) |
| ***C10M 141/12*** | (2006.01) |

(52) U.S. Cl.

CPC ..... *C10M 141/08* (2013.01); *C10M 141/10* (2013.01); *C10M 141/12* (2013.01); *C10M 141/06* (2013.01); *C10M 2207/026* (2013.01); *C10M 2207/044* (2013.01); *C10M 2207/144* (2013.01); *C10M 2207/284* (2013.01); *C10M 2207/289* (2013.01); *C10M 2215/064* (2013.01); *C10M 2215/223* (2013.01); *C10M 2219/066* (2013.01); *C10M 2219/068* (2013.01); *C10M 2223/045* (2013.01); *C10M 2227/09* (2013.01); *C10N 2210/02* (2013.01); *C10N 2210/06* (2013.01); *C10N 2230/06* (2013.01); *C10N 2230/08* (2013.01); *C10N 2230/12* (2013.01); *C10N 2230/38* (2013.01); *C10N 2230/42* (2013.01); *C10N 2230/54* (2013.01); *C10N 2240/10* (2013.01)

(58) Field of Classification Search

CPC ..... C10M 141/06; C10M 141/08; C10M 141/10; C10M 141/12; C10M 2207/026; C10M 2207/044; C10M 2207/284; C10M 2207/289; C10M 2215/064; C10M 2215/223; C10M 2219/066; C10M 2219/068; C10M 2223/045; C10M 2207/144; C10M 2227/09; C10N 2210/02; C10N 2210/06; C10N 2230/06; C10N 2230/12; C10N 2230/38; C10N 2230/42; C10N 2230/54; C10N 2240/10; C10N 2230/08

See application file for complete search history.

(56) References Cited

U.S. PATENT DOCUMENTS

| | | | | |
|---|---|---|---|---|
| 5,744,430 | A | 4/1998 | Inoue et al. | |
| 5,840,672 | A | 11/1998 | Gatto | |
| 5,895,779 | A | 4/1999 | Boffa | |
| 6,063,741 | A | 5/2000 | Naitoh et al. | |
| 6,500,786 | B1 | 12/2002 | Hartley et al. | |
| 6,806,241 | B2 | 10/2004 | Karol et al. | |
| 2002/0019320 | A1 | 2/2002 | Nakazato et al. | |
| 2003/0158051 | A1* | 8/2003 | Karol | C09K 15/28 508/273 |

(Continued)

FOREIGN PATENT DOCUMENTS

| | | | |
|---|---|---|---|
| EP | 2078745 | A1 | 7/2009 |
| EP | 2133406 | A1 | 12/2009 |

(Continued)

OTHER PUBLICATIONS

International Search Report dated May 27, 2011.
European Search Report for corresponding EP application 11760281.3 dated Dec. 22, 2015.

*Primary Examiner* — James Goloboy
(74) *Attorney, Agent, or Firm* — Norris McLaughlin & Marcus P.A.

(57) ABSTRACT

A low-phosphorus lubricating composition having less than 600 ppm phosphorus, comprising at least 85 weight % of a lubricating base blend, and an additive comprising the following, as weight % of the total composition:

(1) an organomolybdenum component comprising:

(a) an organomolybdenum complex, and (b) a molybdenum dithiocarbamate, the organomolybdenum component being present at an amount which provides about 400-800 ppm Mo;

(2) (iso-octyl-3-(3,5-di-tert-butyl-4-hydroxyphenyl) propionate), at about 0.25-1.5%;

(3) a dithiocarbamate component comprising (a) methylene-bis-dialkyldithiocarbamate and (b) said molybdenum dithiocarbamate, at a total dithiocarbamate component of about 0.6-1.2%; and (4) an alkylated diphenyl amine, at about 0.5-1.5%.

1 Claim, No Drawings

(56) References Cited

U.S. PATENT DOCUMENTS

| | | | | |
|---|---|---|---|---|
| 2005/0107269 | A1 | 5/2005 | Yagishita et al. | |
| 2005/0143266 | A1 | 6/2005 | Yagishita | |
| 2005/0166868 | A1 | 8/2005 | Wilk et al. | |
| 2005/0221998 | A1* | 10/2005 | Marumo | C10M 161/00 508/371 |
| 2006/0205615 | A1 | 9/2006 | Esche, Jr. | |
| 2006/0223724 | A1 | 10/2006 | Gatto et al. | |
| 2007/0111904 | A1 | 5/2007 | Van Dam | |
| 2008/0039348 | A1 | 2/2008 | Boffa | |

FOREIGN PATENT DOCUMENTS

| | | | |
|---|---|---|---|
| EP | 2610331 | A1 | 7/2013 |
| WO | 2007115042 | A2 | 10/2007 |

* cited by examiner

ULTRA LOW PHOSPHORUS LUBRICANT COMPOSITIONS

This application is a continuation of U.S. patent application Ser. No. 14/861,521 filed Sep. 22, 2015, which is a continuation of U.S. patent application Ser. No. 14/580,854 filed Dec. 23, 2014, which is a continuation of Ser. No. 14/230,777 filed Mar. 31, 2014, which is continuation of U.S. patent application Ser. No. 13/071,785, filed Mar. 25, 2011, which claims priority of U.S. Provisional Application No. 61/317,499, filed Mar. 25, 2010.

BACKGROUND OF THE INVENTION

Field of the Invention

The invention concerns additive compositions and lubricating compositions for use in a low phosphorus environment, which provide excellent phosphorus retention and improved resistance to lead and copper corrosion.

Discussion of the Prior Art

Government regulations over the last several decades have required Original Equipment Manufacturers (OEMs) to improve fuel economy and reduce pollution emissions for gasoline and diesel powered vehicles. It is common knowledge that OEMs and lubricant companies expect government to mandate even stricter fuel economy and emission requirements in the future. Many, if not all, of the vehicles now on the road contain pollution control devices to reduce pollution.

Engine oils are formulated with antioxidants, friction modifiers, dispersants and antiwear additives to improve vehicle fuel economy, cleanliness and wear. Unfortunately, many of these additives contribute to the fouling of the pollution control devices. When this occurs, vehicles emit high levels of pollution because of the failing performance of the pollution control devices.

It has been determined that high levels of phosphorus, sulfur and ash in gasoline and diesel engine oils can negatively affect the performance of pollution control devices. Not only is the level of phosphorus in engine oil important for the proper performance of pollution control devices but also phosphorus volatility. Phosphorous volatility can have a significant negative impact on the performance of pollution control devices. For example, phosphorus compounds with a high level of phosphorus volatility will have a greater negative impact on the performance of vehicle pollution control devices than phosphorus compounds with a low level of phosphorus volatility. New gasoline and diesel engine oil specifications require engine oils to contain low levels of phosphorus, sulfur and ash to protect the pollution control devices. Unfortunately, the antiwear additives used in engine oils to protect the engine contain sulfur and phosphorus. To ensure proper wear protection for gasoline powered engines and the pollution control equipment, GF-5, the most recent engine oil specification for gasoline powered vehicles, specifies a phosphorus range of 600 and 800 ppm and phosphorus volatility retention of at least 79% minimum.

Molybdenum additives are well known to those skilled in the art of oil formulation to act as friction modifiers to reduce engine friction and thereby improve vehicle fuel economy. However, it is also well known that high levels of molybdenum in engine oil can cause engine corrosion and wear. When this occurs, engine life expectancy is greatly reduced.

U.S. Pat. No. 6,806,241, which is incorporated herein by reference, teaches a three-component antioxidant additive comprising: (1) an organomolybdenum compound, (2) an alklyated diphenylamine and (3) a sulfur compound being a thiadiazole and/or dithiocarbamate.

U.S. Pat. No. 5,840,672, which is incorporated herein by reference, describes an antioxidant system for lubrication base oils as a three-component system comprising (1) an organomolybdenum compound, (2) an alkylated diphenylamine and (3) a sulfurized olefin and/or sulfurized hindered phenol.

SUMMARY OF THE INVENTION

A novel lubricant composition has been discovered that contains friction modifiers, antiwear additives, antioxidants and corrosion inhibitors with a high molybedenum and low phosphorus content that offers excellent fuel economy while maintaining good corrosion and wear protection and significantly reduced level of phosphorus volatility. The novel lubricant composition contains 600 ppm or less of phosphorus and 800 ppm or less of molybedenum. It can be used as a top treat to existing fully formulated gasoline or diesel engine oils or combined with one or more dispersants, detergents, VI improvers, base oils and any other additive(s) needed to make fully formulated engine oil.

System A.

Surprisingly, it has been discovered that the above objectives can be achieved with an additive composition in combination with a lubricating base blend to form a lubricating composition, the additive comprising, as weight percent of a total lubricating composition (1) an organomolybdenum compound, which provides about 0.1-800 ppm Mo, preferably 50-800 ppm, more preferably about 700 ppm;
(2) an alkylated diphenylamine, at about 0.1-2.0%, preferably about 0.25-1.25%, more preferably about 0.5-1.5%;
(3) a hindered phenol, at about 0.1-2.0%, preferably about 0.5-1.5%, more preferably about 0.75-1.5% and
(4) a dithiocarbamate, at about 0.1-2.0%, preferably about 0.25-1.5%, more preferably about 0.4-1.0%, and most preferably about 0.4-0.9%.

System B.

It has also been discovered that surprising results in terms of corrosion resistance are achieved by an alternate embodiment, in which the presence of zinc dithiocarbamate obviates the need for an alklyated diphenylamine. The additive composition comprises, in combination with a lubricating base blend to form a lubricating composition, following in weight % of the total lubricating composition:

(1) an organomolybdenum compound, which provides about 0.1-800 ppm Mo, preferably 50-800 ppm, more preferably about 700 ppm;
(2) a hindered phenol, at about 0.1-2.0%, preferably 0.5-2.0%; more preferably about 0.50-1.5%, and
(3) a zinc dithiocarbamate, at about 0.1-2.0%, preferably 0.5-1.5%, more preferably about 0.5-1.0%.

A particular embodiment of System B, therefore, is as a lubricating composition comprising a base blend in combination with the System B additive, which lubricating composition is substantially free of alkylated diphenylmamine.

DETAILED DESCRIPTION OF THE INVENTION

(1) Organomolybdenum Compound

A preferred organomolybdenum compound is prepared by reacting about 1 mole of fatty oil, about 1.0 to 2.5 moles of diethanolamine and a molybdenum source sufficient to yield about 0.1 to 12.0 percent of molybdenum based on the weight of the complex at elevated temperatures (i.e. greater than room temperature). A temperature range of about 70° to 160° C. is considered to be an example of an embodiment of the invention. The organomolybdenum component of the invention is prepared by sequentially reacting fatty oil, diethanolamine and a molybdenum source by the condensation method described in U.S. Pat. No. 4,889,647, incorporated herein by reference, and is commercially available from R.T. Vanderbilt Company, Inc. of Norwalk, Conn. as Molyvan® 855. The reaction yields a reaction product mixture. The major components are believed to have the structural formulae:

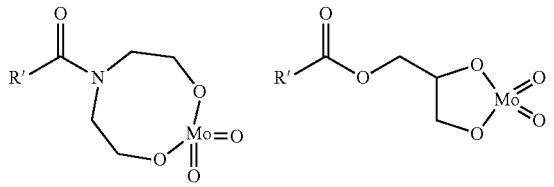

wherein R' represents a fatty oil residue. An embodiment for the present invention are fatty oils which are glyceryl esters of higher fatty acids containing at least 12 carbon atoms and may contain 22 carbon atoms and higher. Such esters are commonly known as vegetable and animal oils. Examples of useful vegetable oils are oils derived from coconut, corn, cottonseed, linseed, peanut, soybean and sunflower seed. Similarly, animal fatty oils such as tallow may be used. The source of molybdenum may be an oxygen-containing molybdenum compound capable of reacting with the intermediate reaction product of fatty oil and diethanolamine to form an ester-type molybdenum complex. The source of molybdenum includes, among others, ammonium molybdates, molybdenum oxides and mixtures thereof.

A sulfur- and phosphorus-free organomolybdenum compound that may be used may be prepared by reacting a sulfur- and phosphorus-free molybdenum source with an organic compound containing amino and/or alcohol groups. Examples of sulfur- and phosphorus-free molybdenum sources include molybdenum trioxide, ammonium molybdate, sodium molybdate and potassium molybdate. The amino groups may be monoamines, diamines, or polyamines. The alcohol groups may be mono-substituted alcohols, diols or bis-alcohols, or polyalcohols. As an example, the reaction of diamines with fatty oils produces a product containing both amino and alcohol groups that can react with the sulfur- and phosphorus-free molybdenum source.

Examples of sulfur- and phosphorus-free organomolybdenum compounds include the following:

1. Compounds prepared by reacting certain basic nitrogen compounds with a molybdenum source as described in U.S. Pat. Nos. 4,259,195 and 4,261,843.
2. Compounds prepared by reacting a hydrocarbyl substituted hydroxy alkylated amine with a molybdenum source as described in U.S. Pat. No. 4,164,473.
3. Compounds prepared by reacting a phenol aldehyde condensation product, a mono-alkylated alkylene diamine, and a molybdenum source as described in U.S. Pat. No. 4,266,945.
4. Compounds prepared by reacting a fatty oil, diethanolamine, and a molybdenum source as described in U.S. Pat. No. 4,889,647.
5. Compounds prepared by reacting a fatty oil or acid with 2-(2-aminoethyl)aminoethanol, and a molybdenum source as described in U.S. Pat. No. 5,137,647.
6. Compounds prepared by reacting a secondary amine with a molybdenum source as described in U.S. Pat. No. 4,692,256.
7. Compounds prepared by reacting a diol, diamino, or amino-alcohol compound with a molybdenum source as described in U.S. Pat. No. 5,412,130.
8. Compounds prepared by reacting a fatty oil, monoalkylated alkylene diamine, and a molybdenum source as described in U.S. Pat. No. 6,509,303.
9. Compounds prepared by reacting a fatty acid, monoalkylated alkylene diamine, glycerides, and a molybdenum source as described in U.S. Pat. No. 6,528,463.

Examples of commercially available sulfur- and phosphorus-free oil soluble molybdenum compounds are available under the trade name SAKURA-LUBE from Asahi Denka Kogyo K.K., and MOLYVAN®. from R. T. Vanderbilt Company, Inc.

Sulfur-containing organomolybdenum compounds may be used and may be prepared by a variety of methods. One method involves reacting a sulfur and phosphorus-free molybdenum source with an amino group and one or more sulfur sources. Sulfur sources can include for example, but are not limited to, carbon disulfide, hydrogen sulfide, sodium sulfide and elemental sulfur. Alternatively, the sulfur-containing molybdenum compound may be prepared by reacting a sulfur-containing molybdenum source with an amino group or thiuram group and optionally a second sulfur source. Examples of sulfur- and phosphorus-free molybdenum sources include molybdenum trioxide, ammonium molybdate, sodium molybdate, potassium molybdate, and molybdenum halides. The amino groups may be monoamines, diamines, or polyamines. As an example, the reaction of molybdenum trioxide with a secondary amine and carbon disulfide produces molybdenum dithiocarbamates. Alternatively, the reaction of $(NH_4)_2Mo_3S_{13}.H_2O$ where n varies between 0 and 2, with a tetralkylthiuram disulfide, produces a trinuclear sulfur-containing molybdenum dithiocarbamate.

Examples of sulfur-containing organomolybdenum compounds appearing in patents and patent applications include the following:

1. Compounds prepared by reacting molybdenum trioxide with a secondary amine and carbon disulfide as described in U.S. Pat. Nos. 3,509,051 and 3,356,702.
2. Compounds prepared by reacting a sulfur-free molybdenum source with a secondary amine, carbon disulfide, and an additional sulfur source as described in U.S. Pat. No. 4,098,705.
3. Compounds prepared by reacting a molybdenum halide with a secondary amine and carbon disulfide as described in U.S. Pat. No. 4,178,258.
4. Compounds prepared by reacting a molybdenum source with a basic nitrogen compound and a sulfur source as described in U.S. Pat. Nos. 4,263,152, 4,265,773, 4,272,387, 4,285,822, 4,369,119, and 4,395,343.
5. Compounds prepared by reacting ammonium tetrathiomolybdate with a basic nitrogen compound as described in U.S. Pat. No. 4,283,295.
6. Compounds prepared by reacting an olefin, sulfur, an amine and a molybdenum source as described in U.S. Pat. No. 4,362,633.
7. Compounds prepared by reacting ammonium tetrathiomolybdate with a basic nitrogen compound and an organic sulfur source as described in U.S. Pat. No. 4,402,840.

8. Compounds prepared by reacting a phenolic compound, an amine and a molybdenum source with a sulfur source as described in U.S. Pat. No. 4,466,901.
9. Compounds prepared by reacting a triglyceride, a basic nitrogen compound, a molybdenum source, and a sulfur source as described in U.S. Pat. No. 4,765,918.
10. Compounds prepared by reacting alkali metal alkylthioxanthate salts with molybdenum halides as described in U.S. Pat. No. 4,966,719.
11. Compounds prepared by reacting a tetralkylthiuram disulfide with molybdenum hexacarbonyl as described in U.S. Pat. No. 4,978,464.
12. Compounds prepared by reacting an alkyl dixanthogen with molybdenum hexacarbonyl as described in U.S. Pat. No. 4,990,271.
13. Compounds prepared by reacting alkali metal alkylxanthate salts with dimolybdenum tetra-acetate as described in U.S. Pat. No. 4,995,996.
14. Compounds prepared by reacting $(NH_4)_2Mo_3S_{13}.H_2O$ with an alkali metal dialkyldithiocarbamate or tetralkyl thiuram disulfide as described in U.S. Pat. No. 6,232,276.
15. Compounds prepared by reacting an ester or acid with a diamine, a molybdenum source and carbon disulfide as described in U.S. Pat. No. 6,103,674.
16. Compounds prepared by reacting an alkali metal dialkyldithiocarbamate with 3-chloropropionic acid, followed by molybdenum trioxide, as described in U.S. Pat. No. 6,117,826.
17. Trinuclear moly compounds prepared by reacting a moly source with a ligand sufficient to render the moly additive oil soluble and a sulfur source as described in U.S. Pat. Nos. 6,232,276; 7,309,680 and WO99/31113, e.g. Infineum® C9455B.

Examples of commercially available sulfur-containing oil soluble molybdenum compounds available under the trade name SAKURA-LUBE, from Asahi Denka Kogyo K.K., MOLYVAN® additives from R. T. Vanderbilt Company, and NAUGALUBE from Crompton Corporation.

Molybdenum dithiocarbamates may be present as either the organomolybdem compound and/or as the dithiocarbamate, and may be illustrated by the following structure,

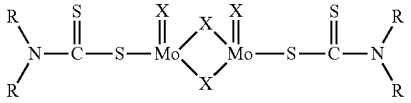

where R is an alkyl group containing 4 to 18 carbons or H, and X is O or S.

Other oil-soluble organomolybdenum compounds which may be used in the present invention include molybdenum dithiocarbamates, amine molybdates, molybdate esters, molybdate amides and alkyl molybdates.

It is contemplated that oil-soluble organotungsten compounds may be substituted for the organomolybdenum compound, including amine tungstate (Vanlube® W 324) and tungsten dithiocarbamates.

(2) Alkylated Diphenyl Amines (ADPA)

Alkylated diphenyl amines are widely available antioxidants for lubricants. One possible embodiment of an alkylated diphenyl amine for the invention are secondary alkylated diphenylamines such as those described in U.S. Pat. No. 5,840,672, which is hereby incorporated by reference. These secondary alkylated diphenylamines are described by the formula X—NH—Y, wherein X and Y each independently represent a substituted or unsubstituted phenyl group having wherein the substituents for the phenyl group include alkyl groups having 1 to 20 carbon atoms, preferably 4-12 carbon atoms, alkylaryl groups, hydroxyl, carboxy and nitro groups and wherein at least one of the phenyl groups is substituted with an alkyl group of 1 to 20 carbon atoms, preferably 4-12 carbon atoms. It is also possible to use commercially available ADPAs including VANLUBE® SL (mixed alklyated diphenylamines), DND, NA (mixed alklyated diphenylamines), 81 (p,p'-dioctyldiphenylamine) and 961 (mixed oxylated and butylated diphenylamines) manufactured by R. T. Vanderbilt Company, Inc., Naugalube® 640, 680 and 438L manufactured by Chemtura Corporation and Irganox® L-57 and L-67 manufactured by Ciba Specialty Chemicals Corporation and Lubrizol 5150A & C manufactured by Lubrizol. Another possible ADPA for use in the invention is a reaction product of N-phenyl-benzenamine and 2,4,4-trimethylpentene.

Alkylated diphenylamines, also known as diarylamine antioxidants, include, but are not limited to diarylamines having the formula:

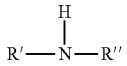

wherein R' and R" each independently represents a substituted or unsubstituted aryl group having from 6 to 30 carbon atoms. Illustrative of substituents for the aryl group include aliphatic hydrocarbon groups such as alkyl having from 1 to 30 carbon atoms, hydroxy groups, halogen radicals, carboxylic acid or ester groups, or nitro groups.

The aryl group is preferably substituted or unsubstituted phenyl or naphthyl, particularly wherein one or both of the aryl groups are substituted with at least one alkyl having from 4 to 30 carbon atoms, preferably from 4 to 18 carbon atoms, most preferably from 4 to 9 carbon atoms. It is preferred that one or both aryl groups be substituted, e.g. mono-alkylated diphenylamine, di-alkylated diphenylamine, or mixtures of mono- and di-alkylated diphenylamines.

The diarylamines may be of a structure containing more than one nitrogen atom in the molecule. Thus the diarylamine may contain at least two nitrogen atoms wherein at least one nitrogen atom has two aryl groups attached thereto, e.g. as in the case of various diamines having a secondary nitrogen atom as well as two aryls on one of the nitrogen atoms.

Examples of diarylamines that may be used include, but are not limited to: diphenylamine; various alkylated diphenylamines; 3-hydroxydiphenylamine; N-phenyl-1,2-phenylenediamine; N-phenyl-1,4-phenylenediamine; monobutyldiphenylamine; dibutyldiphenylamine; monooctyldiphenylamine; dioctyldiphenylamine; monononyldiphenylamine; dinonyldiphenylamine; monotetradecyldiphenylamine; ditetradecyldiphenylamine, phenyl-alpha-naphthylamine; monooctyl phenyl-alpha-naphthylamine; phenyl-beta-naphthylamine; monoheptyldiphenylamine; diheptyldiphenylamine; p-oriented styrenated diphenylamine; mixed butyloctyldiphenylamine; and mixed octylstyryldiphenylamine.

Examples of commercially available diarylamines include, for example, diarylamines available under the trade name IRGANOX® from Ciba Specialty Chemicals; NAUGALUBE® from Crompton Corporation;

GOODRITE® from BF Goodrich Specialty Chemicals; VANLUBE® from R. T. Vanderbilt Company Inc.

Another class of aminic antioxidants includes phenothiazine or alkylated phenothiazine having the chemical formula:

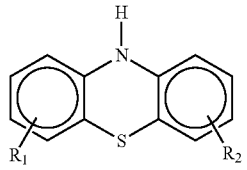

wherein $R_1$ is a linear or branched $C_1$ to $C_{24}$ alkyl, aryl, heteroalkyl or alkylaryl group and $R_2$ is hydrogen or a linear or branched $C_1$ to $C_{24}$ alkyl, heteroalkyl, or alkylaryl group. Alkylated phenothiazine may be selected from the group consisting of monotetradecylphenothiazine, ditetradecylphenothiazine, monodecylphenothiazine, didecylphenothiazine, monononylphenothiazine, dinonylphenothiazine, monoctylphenothiazine, dioctylphenothiazine, monobutylphenothiazine, dibutylphenothiazine, monostyrylphenothiazine, distyrylphenothiazine, butyloctylphenothiazine, and styryloctylphenothiazine.

(3) Hindered Phenol

The hindered phenol may be of the formula:

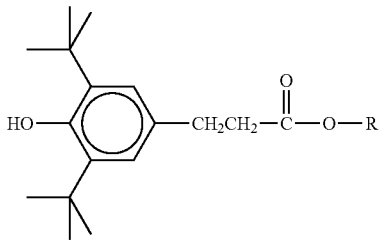

where R=alkyl group with 4-16 carbons, or the hindered phenol is bis-2'6'-di tert butyl phenol. Preferred alkyl groups are butyl, ethylhexyl, iso-octyl, isostearyl and stearyl. A particularly preferred hindered phenol is available from R.T. Vanderbilt Company, Inc. as Vanlube® BHC (Iso-octyl-3-(3,5-di-tert-butyl-4-hydroxyphenyl) propionate) also known as butyl hydroxy-hydrocinnamate. Other hindered phenols may include oil-soluble non-sulfur phenolics, including but not limited to those described in U.S. Pat. No. 5,772,921, incorporated herein by reference.

Non-limiting examples of sterically hindered phenols include, but are not limited to, 2,6-di-tertiary butylphenol, 2,6 di-tertiary butyl methylphenol, 4-ethyl-2,6-di-tertiary butylphenol, 4-propyl-2,6-di-tertiary butylphenol, 4-butyl-2,6-di-tertiary butylphenol, 4-pentyl-2,6-di-tertiary butylphenol, 4-hexyl-2,6-di-tertiary butylphenol, 4-heptyl-2,6-di-tertiary butylphenol, 4-(2-ethylhexyl)-2,6-di-tertiary butylphenol, 4-octyl-2,6-di-tertiary butylphenol, 4-nonyl-2,6-di-tertiary butylphenol, 4-decyl-2,6-di-tertiary butylphenol, 4-undecyl-2,6-di-tertiary butylphenol, 4-dodecyl-2,6-di-tertiary butylphenol, methylene bridged sterically hindered phenols including but not limited to 4,4-methylenebis(6-tert-butyl-o-cresol), 4,4-methylenebis(2-tert-amyl-o-cresol), 2,2-methylenebis(4-methyl-6 tert-butylphenol, 4,4-methylene-bis(2,6-di-tert-butylphenol) and mixtures thereof as described in U.S. Publication No. 2004/0266630.

(4) Dithiocarbamate (i) Ashless Bisdithiocarbamate

The bisdithiocarbamates of formula II are known compounds described in U.S. Pat. No. 4,648,985, incorporated herein by reference:

(II)

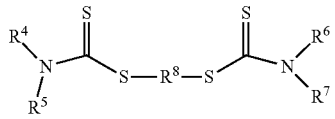

The compounds are characterized by $R^4$, $R^5$, $R^6$ and $R^7$ which are the same or different and are hydrocarbyl groups having 1 to 13 carbon atoms. Embodiments for the present invention include bisdithiocarbamates wherein $R^4$, $R^5$, $R^6$ and $R^7$ are the same or different and are branched or straight chain alkyl groups having 1 to 8 carbon atoms. $R^8$ is an aliphatic group such as straight and branched alkylene groups containing 1 to 8 carbons.

A preferred ashless dithiocarbamate is methylene-bis-dialkyldithiocarbamate, where alkyl groups contain 3-16 carbon atoms, and is available commercially under the tradename VANLUBE® 7723 from R.T. Vanderbilt Company, Inc.

The ashless dialkyldithiocarbamates include compounds that are soluble or dispersable in the additive package. It is also preferred that the ashless dialkyldithiocarbamate be of low volatility, preferably having a molecular weight greater than 250 daltons, most preferably having a molecular weight greater than 400 daltons. Examples of ashless dithiocarbamates that may be used include, but are not limited to, methylenebis(dialkyldithiocarbamate), ethylenebis(dialkyldithiocarbamate), isobutyl disulfide-2,2'-bis(dialkyldithiocarbamate), hydroxyalkyl substituted dialkyldithiocarbamates, dithiocarbamates prepared from unsaturated compounds, dithiocarbamates prepared from norbornylene, and dithiocarbamates prepared from epoxides, where the alkyl groups of the dialkyldithiocarbamate can preferably have from 1 to 16 carbons. Examples of dialkyldithiocarbamates that may be used are disclosed in the following patents: U.S. Pat. Nos. 5,693,598; 4,876,375; 4,927,552; 4,957,643; 4,885,365; 5,789,357; 5,686,397; 5,902,776; 2,786,866; 2,710,872; 2,384,577; 2,897,152; 3,407,222; 3,867,359; and 4,758,362.

Examples of preferred ashless dithiocarbamates are:

Methylenebis(dibutyldithiocarbamate), Ethylenebis(dibutyldithiocarbamate), Isobutyl disulfide-2,2'-bis(dibutyldithiocarbamate), Dibutyl-N,N-dibutyl-(dithiocarbamyl)succinate, 2-hydroxypropyl dibutyldithiocarbamate, Butyl (dibutyldithiocarbamyl)acetate, and S-carbomethoxy-ethyl-N,N-dibutyl dithiocarbamate. The most preferred ashless dithiocarbamate is methylenebis(dibutyldithiocarbamate).

(ii) Ashless Dithiocarbamate Ester.

(III)

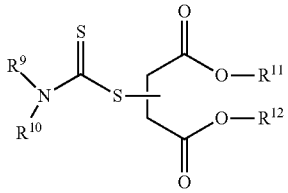

The compounds of formula III are characterized by groups $R^9$, $R^{10}$, $R^{11}$ and $R^{12}$ which are the same or different and are hydrocarbyl groups having 1 to 13 carbon atoms. VANLUBE® 732 (dithiocarbamate derivative) and VANLUBE® 981 (dithiocarbamate derivative) are commercially available from R.T. Vanderbilt Company, Inc.

(iii) Metal Dithiocarbamates.

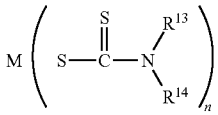

(IV)

The dithiocarbamates of the formula IV are known compounds. One of the processes of preparation is disclosed in U.S. Pat. No. 2,492,314, which is hereby incorporated by reference. $R^{13}$ and $R^{14}$ in the formula IV represent branched and straight chain alkyl groups having 1 to 8 carbon atoms, M is a metal cation and n is an integer based upon the valency of the metal cation (e.g. n=1 for sodium ($Na^+$); n=2 for zinc ($Zn^{2+}$); etc.). Molybdenum dithiocarbamate processes are described in U.S. Pat. Nos. 3,356,702; 4,098,705; and 5,627,146, each of which is hereby incorporated by reference. Substitution is described as branched or straight chain ranging from 8 to 13 carbon atoms in each alkyl group.

Embodiments for the present invention include metal dithiocarbamates such as antimony, zinc, tungsten and molybdenum dithiocarbamates. A preferred metal dithiocarbamate is zinc diamyldithiocarbamate, available as Vanlube® AZ, but may also be zinc dibutyldithiocarbamate or piperidinium pentamethylene dithiocarbamate It is noted that molybdenum dithiocarbamate (e.g. molybdenum dialkyl dithiocarbamate available as Molyvan® 822) may be used in the present invention as both the required organomolybdenum compound and/or as the required dithiocarbamate. Where present as the sole dithiocarbamate, the relative amount of molybdenum dithiocarbamate should be counted as per the dithiocarbamate requirement set forth herein. Where a further dithiocarbamate is also present (e.g. zinc dithiocarbamate or ashless dithiocarbamate), the MoDTC should be counted toward the organomolybdenum compound requirement.

The components of the additive compositions of the invention can either be added individually to a base blend to form the lubricating composition of the invention or they can be premixed to form an additive composition which can then be added to the base blend. The resulting lubricating composition should comprise a major amount (i.e. at least 85% by weight) of base blend and a minor amount (i.e. less than 10% by weight, preferably about 2-5%) of the additive composition.

In order to satisfy the desire of industry to have an ultra-low phosphorus lubricating composition, the phosphorus level should be less than 600 ppm, preferably less than 300 ppm. The phosphorus may be provided in the form of zinc dialklydithiophosphate (ZDDP), in either conventional or fluorinated form (F-ZDDP), or as any ashless phosphorus source. It is also noted that while the inventive additive composition works to surprisingly reduce corrosion in ultra-low phosphorus oils, use of the additive composition is contemplated for base oils regardless of the phosphorus level.

Molybdenum from the organomolybdenum compound should be in the range of 0.1-800 ppm as part of the entire lubricating oil composition. Alkylated diphenylamine should be in the range of about 0.1% to 2.0%; Hindered phenol should be in the range of about 0.1% to 2.0%; and the dithiocarbamate should be in the range of 0.1 to 2.0%.

Zinc dialkyl dithiophosphates ("ZDDPs") are also used in lubricating oils. ZDDPs have good antiwear and antioxidant properties and have been used to pass cam wear tests, such as the Seq. IVA and TU3 Wear Test. Many patents address the manufacture and use of ZDDPs including U.S. Pat. Nos. 4,904,401; 4,957,649; and 6,114,288. Non-limiting general ZDDP types are primary, secondary and mixtures of primary and secondary ZDDPs. mixtures of primary and secondary ZDDPs and low volatility phosphorous compounds described in, and function the same as the antiwear additives described in, the non-limiting patent applications US 2010/0062956 and US 2010/0056407. It is not necessary for the low volatility phosphorus containing antiwear additive to contain zinc. Nitrogen containing compounds can also be used in place of zinc. The terms low volatility is defined by the GF-5 specification. The GF-5 specification is the next passenger car motor oil specification which limits phosphorous volatility. Modification to this term in subsequent gasoline and diesel engine oil specifications are also included for reference. In general, any low volatile, phosphorus containing antiwear additive is suitable for use with this invention.

Base Oils

A suitable base blend is any partially formulated engine oil consisting of one or more base oils, dispersants, detergents, VI improvers and any other additives such that when combined with the inventive composition constitutes a fully formulated motor oil. A base blend can also be any fully formulated engine oil for any gasoline, diesel, natural gas, bio-fuel powered vehicle that is top treated with the inventive composition. Base oils suitable for use in formulating the compositions, additives and concentrates described herein may be selected from any of the synthetic or natural oils or mixtures thereof. The synthetic base oils include alkyl esters of dicarboxylic acids, polyglycols and alcohols, poly-alpha-olefins, including polybutenes, alkyl benzenes, organic esters of phosphoric acids, polysilicone oils, and alkylene oxide polymers, interpolymers, copolymers and derivatives thereof where the terminal hydroxyl groups have been modified by esterification, etherification, and the like.

Natural base oils include animal oils and vegetable oils (e.g., castor oil, lard oil), liquid petroleum oils and hydrorefined, solvent-treated or acid-treated mineral lubricating oils of the paraffinic, naphthenic and mixed paraffinic-naphthenic types. Oils of lubricating viscosity derived from coal or shale are also useful base oils. The base oil typically has a viscosity of about 2.5 to about 15 cSt and preferably about 2.5 to about 11 cSt at 100° C.

The data in Table 1 demonstrate the superior Cu/Pb corrosion protection offered by the inventive additive composition, where numbers indicate weight percent as part of the entire lubricant composition. Corrosion resistance is measured according to HTCBT, High Temperature Corrosion Bench Test (ASTM D 6594), wherein lower number indicates less corrosion. The comparative prior art compounds C1, C5 and C10 are prepared according to U.S. Pat. No. 6,806,241. The molybdenum ester/amide can be found commercially as Molyvan® 855, manufactured by R.T. Vanderbilt Company.

TABLE 1

| High Temperature Corrosion Bench Test Data | | | | | | | | | | |
|---|---|---|---|---|---|---|---|---|---|---|
| | C1 | 2 | 3 | 4 | C5 | 6 | 7 | 8 | 9 | C10 |
| Base Blend* | 95.00 | 95.00 | 95.00 | 95.00 | 95.00 | 95.00 | 95.00 | 95.00 | 95.00 | 95.00 |
| Diluent Oil** | 1.40 | 1.40 | 1.40 | 0.90 | 2.00 | 2.00 | 2.00 | 1.00 | 0.80 | 2.00 |
| Butyl Hydroxy-hydrocinnamate | | 1.50 | 0.75 | 1.50 | | 1.50 | 0.75 | 0.75 | 1.50 | |
| Molybdenum ester/amide, 7.9% Mo | 0.90 | 0.90 | 0.90 | 0.90 | 0.90 | 0.90 | 0.90 | 0.90 | 0.50 | 0.90 |
| Molybdenum dithiocarbamate, 4.9% Mo | | | | | | | | | 0.60 | |
| Styryl/octyl diphenylamine | 1.50 | | 0.75 | 0.50 | 1.50 | | 0.75 | 0.75 | 0.50 | 1.50 |
| Zinc dialkyldithiocarbamate, 50% active | 1.00 | 1.00 | 1.00 | 1.00 | | | | 1.00 | 0.50 | |
| Zinc dialkyldithiophosphate (1), 7.5% P | 0.20 | 0.20 | 0.20 | 0.20 | 0.20 | 0.20 | 0.20 | 0.20 | 0.20 | |
| Methylene-bis dibutyl, dithiocarbamate | | | | | 0.40 | 0.40 | 0.40 | 0.40 | 0.40 | 0.40 |
| Zinc dialkyldithiophosphate (2), 7.5% P | | | | | | | | | | 0.20 |
| Tolutriazole derivative | | | | | | | | | | |
| TOTAL | 100.00 | 100.00 | 100.00 | 100.00 | 100.00 | 100.00 | 100.00 | 100.00 | 100.00 | 100.00 |
| Molybdenum content, ppm (nominal) | 700 | 700 | 700 | 700 | 700 | 700 | 700 | 700 | 700 | 700 |
| Phosphorus content, ppm (nominal) | 150 | 150 | 150 | 150 | 150 | 150 | 150 | 150 | 150 | 150 |
| HTBCT corrosion, Cu + Pb (ppm) | 369 | 81 | 20 | 59 | 600 | 563 | 268 | 132 | 132 | 351 |
| HTCBT Cu/Pb (ppm) | 43/326 | 17/64 | 12/8 | 0/59 | 192/408 | 148/415 | 204/64 | 63/69 | 63/69 | 227/124 |

*Base blend is a GF-4 base oil including dispersant, detergent, and viscosity modifier
**Diluent is base oil without additives to bring the total to 100%.

It can be seen that the four component system, based on zinc dialkyldithiocarbamate, as set out in examples 3 and 4, provides vastly superior corrosion inhibition compared to prior art example C1 (lacking hindered phenol). Example 7, based on ashless dithiocarbamate, provides superior results compared to prior art example C5 (which lacks a hindered phenol). Additive compositions based on ashless dialkyldithiocarbamate achieve improved results when accompanied by a zinc dialkyldithiocarbamate (example 8, 9). Surprisingly, it is seen that the presence of zinc dialkyldithiocarbamate results in excellent protection, even without ADPA, as shown in Example 2; while using only ashless dialkyldithiocarbamate without zinc dialkyldithiocarbamate (example 6) requires the presence of ADPA in order to achieve the desired synergy.

ASTM Test Method D 7589 measures the effects of automotive engine oils on the fuel economy of passenger cars and light duty trucks in the Sequence VID spark ignition engine. Fuel economy of the candidate oil is measured as % improvement over the SAE 10W-30 reference oil. FEI1 represents the "initial" fuel economy improvement (measured after 16 hours of break-in) and FEI2 represents the "aged" fuel economy improvement (measured after 100 hours of operation). The following data contains several different GF-4 formulations from the current invention (Systems A and B) that were run in this test, demonstrating superior fuel economy. The GF-4 base blend used in all formulations contains typical levels of dispersant and detergent additives and OCP viscosity modifier in Group III basestock. All formulations contain alkylated diphenylamine, hindered phenolic, and dithiocarbamate antioxidants. Formulation 15 is similar to Formulation 14, except it contains a much higher level of molybdenum and results in much improved fuel economy. Formulation 16 contains similar level of molybdenum as Formulation 15, but from a different organomolybdenum source, as well as an ashless dialkyldithiocarbamate. Formulation 16 also exhibits much improved fuel economy in the Seq. VID engine test.

TABLE 2

| Engine Test Data | | | | | | |
|---|---|---|---|---|---|---|
| | 14 | 15 | 16 | 17 | 17' | GF-4 Requirement |
| Formulation | | | | | | |
| SAE Viscosity Grade | 5W-20 | 5W-20 | 5W-20 | 5W-30 | 5W-30 | |
| GF-4 Base | 95.50 | 95.25 | 96.20 | 96.05 | 96.05 | |
| Hindered phenol ester | 1.25 | 1.25 | 1.25 | 1.25 | 1.25 | |
| Alkylated diphenylamine | 0.75 | 0.75 | 0.75 | 0.75 | 0.75 | |
| ZDDP, 7.5% P | 0.35 | 0.35 | 0.20 | 0.35 | 0.35 | |
| Molybdenum ester/amide, 8% Mo | 0.15 | 0.90 | 0.50 | 0.50 | 0.50 | |
| Molybdenum dithiocarbamate, 5% Mo | — | — | 0.60 | 0.60 | 0.60 | |
| Borate ester, 1% B | 0.50 | 0.50 | — | — | — | |
| Zinc dithiocarbamate (50% active?) | 1.00 | 1.00 | — | — | — | |

TABLE 2-continued

| Engine Test Data | 14 | 15 | 16 | 17 | 17' | GF-4 Requirement |
|---|---|---|---|---|---|---|
| ashless bis-dithiocarbamate | — | — | 0.40 | 0.40 | 0.40 | |
| Triazole derivative | — | — | 0.10 | 0.10 | 0.10 | |
| Non-molybdenum friction modifier | 0.50 | — | — | — | — | |
| **Viscosity Analysis** | | | | | | |
| HTHS150, cP | NR | NR | 2.70 | 3.10 | 3.09 | 2.6 min. (5W-20)<br>2.9 min. (5W-30) |
| kV100, fresh | 8.64 | 8.63 | NR | NR | 10.74 | 9.3 max. (5W-20)<br>12.5 max. (5W-30) |
| **Elemental Analysis** | | | | | | |
| Calcium, ppm | 2068 | 2095 | 1982 | 1926 | 1972 | No limit |
| Molybdenum, ppm | 118 | 726 | 725 | 691 | 679 | No limit |
| Phosphorus, ppm | 248 | 259 | 169 | 238 | 250 | 800 ppm max. |
| Zinc, ppm | 912 | 925 | 173 | 256 | 283 | No limit |
| **Sequence VID Results** | | | | | | |
| FEI1, % | 1.04 | 1.23 | 1.49 | NR | NR | No limit |
| FEI2, % | 0.80 | 1.12 | 1.26 | NR | NR | 0.9% min. (5W-20) |
| FEISum, % | 1.84 | 2.35 | 2.75 | NR | NR | 2.1% min. (5W-20) |
| **Sequence IIIG Results** | | | | | | |
| Viscosity increase, % | NR | NR | NR | 54.8 | 74.8 | 150% min. |
| Weighted Piston Deposits, merit | NR | NR | NR | 4.18 | 3.22 | 3.5 min. |
| Avg. Cam & Lifter Wear, microns | NR | NR | NR | 22.6 | 37.9 | 60 max. |
| Phosphorus retention, % | NR | NR | NR | 92.2 | 87.6 | 79% min. (GF-5 only) |

The Sequence IIIG engine test measures oil thickening, piston deposit formation, and valve train wear during high-temperature conditions, simulating high-speed service during relatively high ambient temperature conditions using a 1996/1997 3.8 L Series II General Motors V-6 fuel-injected gasoline engine running on unleaded gasoline, operating at 125 bhp, 3,600 rpm, and 150° C. oil temperature for 100 hours according to ASTM D7320 test method. It is a severe test that is very difficult to pass with engine oil formulations containing less then 400 ppm phosphorus.

Exhaust system catalyst compatibility of engine oils is measured by calculating the percent phosphorus retained in the engine oil at the end of the Sequence IIIG engine test. It is well known that phosphorus compounds that are volatilized from the engine oil can find their way through the engine's exhaust system and eventually reduce the efficiency of the exhaust system catalyst via poisoning effects, adversely affecting the vehicle compliance with government-regulated emissions requirements.

Formulations 17 and 17' (a reblend of 17) were subjected to the ASTM D7320 test protocol at two different test laboratories. In both cases, the oil formulations exhibited excellent oxidation and wear control. The ILSAC GF-4 specification requires oil viscosity increase of 150% maximum, weighted piston deposit merit rating of 3.5 minimum, and average cam & lifter wear of 60 microns maximum. ILSAC GF-4 does not have a requirement for phosphorus retention, however, ILSAC GF-5 requires phosphorus retention to be 79% minimum. Most conventional GF-5 oils on the market have phosphorus retention values in the range of 80-83%. Formulation 17 of the current invention clearly demonstrates superior performance, averaging 90% phosphorus retention based on tests conducted at two different laboratories. In addition, some of the oils of the current invention contain only one-third the amount of phosphorus that is found in conventional GF-5 motor oils. All ILSAC GF-5 motor oils are required to contain 600 ppm phosphorus minimum (for wear control) and 800 ppm phosphorus maximum (for exhaust system compatibility). When combined with the excellent phosphorus retention levels of this invention, the low levels of phosphorus in the engine oil will result in a significant reduction in exhaust system catalyst poisoning and therefore significantly improved exhaust system compatibility.

What is claimed is:

1. A low-phosphorus lubricating composition having less than 600 ppm phosphorus, comprising at least 85 weight % of a lubricating base blend, and an additive comprising the following, as weight % of the total composition:

(1) an organomolybdenum component comprising:

(a) an organomolybdenum complex prepared by reacting about 1 mole of fatty oil, about 1.0 to 2.5 moles of diethanolamine and a molybdenum source sufficient to yield about 0.1 to 12.0 percent of molybdenum, which organomolybdenum complex is present at an amount which provides about 400 ppm Mo, and (b) a molybdenum dithiocarbamate present at an amount which provides about 300 ppm Mo, the organomolybdenum component being present at an amount which provides about 700 ppm Mo;

(2) a hindered phenol component being (iso-octyl-3-(3,5-di-tert-butyl-4-hydroxyphenyl) propionate), at about 1.25-1.5%;

(3) a dithiocarbamate component consisting of (a) about 0.4% of methylene-bis-dialkyldithiocarbamate and (b) said molybdenum dithiocarbamate, at a total dithiocarbamate component of about 1.0%; and (4) an alkylated diphenyl amine, at about 0.5-0.75%.

* * * * *